US010375477B1

(12) United States Patent
Murrish

(10) Patent No.: US 10,375,477 B1
(45) Date of Patent: Aug. 6, 2019

(54) SYSTEM AND METHOD FOR PROVIDING A SHARED AUDIO EXPERIENCE

(71) Applicant: Honda Motor Co., Ltd., Tokyo (JP)

(72) Inventor: Robert Wesley Murrish, Santa Clara, CA (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/156,951

(22) Filed: Oct. 10, 2018

(51) Int. Cl.
*H04R 3/00* (2006.01)
*H04R 29/00* (2006.01)
*H04R 3/14* (2006.01)

(52) U.S. Cl.
CPC ..... *H04R 3/14* (2013.01); *H04R 2420/07* (2013.01); *H04R 2499/11* (2013.01); *H04R 2499/13* (2013.01)

(58) Field of Classification Search
CPC . H04R 3/00; H04R 3/04; H04R 3/007; H04R 3/12; H04R 3/14; H04R 29/00; H04R 29/001; H04R 29/002; H04R 2499/11; H04R 2499/13; H04R 2420/07; H04R 2205/024; H04R 1/323; H04R 5/00; H04R 5/04
See application file for complete search history.

(56) References Cited

U.S. PATENT DOCUMENTS 6,845,308 B2 1/2005 Kobata et al.
7,466,828 B2 12/2008 Ito
9,609,418 B2 3/2017 Macours
2002/0072816 A1* 6/2002 Shdema ..... H04L 12/2805 700/94
2005/0032500 A1 2/2005 Nashif et al.
2005/0074133 A1* 4/2005 Miyashita ..... H03G 5/22 381/103
2005/0195998 A1 9/2005 Yamamoto et al.
2006/0034467 A1 2/2006 Sleboda et al.
2006/0146648 A1* 7/2006 Ukita ..... H04N 7/15 367/129
2006/0188104 A1* 8/2006 De Poortere ..... H03G 3/32 381/57
2007/0003075 A1* 1/2007 Cooper ..... H04S 3/00 381/98
2007/0025559 A1* 2/2007 Mihelich ..... H04S 7/301 381/59
2011/0081024 A1* 4/2011 Soulodre ..... G01S 3/8006 381/17

(Continued)

*Primary Examiner* — Thang V Tran
(74) *Attorney, Agent, or Firm* — Rankin, Hill & Clark LLP

(57) ABSTRACT

A system and method providing a shared audio experience that include receiving data associated with at least one audio stream and analyzing a sound wave associated with the at least one audio stream. The system and method also include determining a plurality of audio frequencies associated with the at least one audio stream based on the analysis of the sound wave. The system and method additionally include determining a plurality of audio elements associated with each of the plurality of audio frequencies associated with the at least one audio stream and determining at least one audio source to provide audio associated with each of the plurality of audio elements. The system and method further include controlling the at least one audio source to provide the audio associated with each of the plurality of audio elements.

20 Claims, 6 Drawing Sheets

(56) References Cited

U.S. PATENT DOCUMENTS

| | | | | |
|---|---|---|---|---|
| 2012/0170762 | A1* | 7/2012 | Kim | H04R 3/12 381/59 |
| 2016/0133257 | A1* | 5/2016 | Namgoong | G10L 15/26 704/235 |
| 2016/0323672 | A1* | 11/2016 | Bhogal | H04R 5/04 |
| 2017/0048606 | A1 | 2/2017 | Fan et al. | |
| 2017/0098457 | A1* | 4/2017 | Zad Issa | G10L 21/0388 |
| 2017/0195795 | A1 | 7/2017 | Mei et al. | |
| 2018/0061434 | A1* | 3/2018 | Otani | H03G 3/32 |
| 2018/0315413 | A1* | 11/2018 | Lee | B60L 1/00 |

* cited by examiner

SYSTEM AND METHOD FOR PROVIDING A SHARED AUDIO EXPERIENCE

BACKGROUND

Wearable computing devices are increasingly becoming popular as they are implemented with a variety of applications, services and interfaces. Typically, wearable computing devices include a display to present data and a speaker system (e.g., headphones) to provide audio associated with the data presented. For example, viewable content may be presented on an optical head mounted display of a wearable computing device and the speaker system of the wearable device may provide audio that may be provided with the content presented.

Currently many individuals may utilize the wearable devices and/or portable devices with headphones to interact with and/or view various types of media (e.g., games, movies, music, and applications). In many cases, the individuals may be non-driving passengers of a vehicle that may utilize the virtual reality headsets and/or portable devices as they are traveling within the vehicle.

Typically, the speakers of the virtual reality headsets and/or portable devices may not be configured to provide symmetrical audio effects to properly provide a high quality audio experience within the interior of the vehicle thereby diminishing the quality of the interaction or viewing of various types of content by the passengers. Also, in some circumstances, external sources of audio provided within the vehicle and/or external noise (e.g., road noise) based on the operation of the vehicle may distort or diminish the quality of a passenger's listening experience through the virtual reality headsets and/or portable devices.

BRIEF DESCRIPTION

According to one aspect, a computer-implemented method for providing a shared audio experience that includes receiving data associated with at least one audio stream. A sound wave is generated from the at least one audio stream. The computer-implemented method also includes analyzing the sound wave associated with the at least one audio stream and determining a plurality of audio frequencies associated with the at least one audio stream based on the analysis of the sound. The computer-implemented method additionally includes determining a plurality of audio elements associated with each of the plurality of audio frequencies associated with the at least one audio stream and determining at least one audio source to provide audio associated with each of the plurality of audio elements. The computer-implemented method further includes controlling the at least one audio source to provide the audio associated with each of the plurality of audio elements. The at least one audio source is at least one of: at least one speaker of a vehicle and a speaker system of a portable device.

According to another aspect, a system for providing a shared audio experience that includes a memory storing instructions when executed by a processor cause the processor to receive data associated with at least one audio stream. A sound wave is generated from the at least one audio stream. The instructions also cause the processor to analyze the sound wave associated with the at least one audio stream and determine a plurality of audio frequencies associated with the at least one audio stream based on the analysis of the sound wave. The instructions additionally cause the processor to determine a plurality of audio elements associated with each of the plurality of audio frequencies associated with the at least one audio stream and determine at least one audio source to provide audio associated with each of the plurality of audio elements. The instructions further cause the processor to control the at least one audio source to provide the audio associated with each of the plurality of audio elements. The at least one audio source is at least one of: at least one speaker of a vehicle and a speaker system of a portable device.

According to still another aspect, a computer readable storage medium storing instructions that when executed by a computer, which includes at least a processor, causes the computer to perform a method that includes receiving data associated with at least one audio stream. A sound wave is generated from the at least one audio stream. The instructions also include analyzing the sound wave associated with the at least one audio stream and determining a plurality of audio frequencies associated with the at least one audio stream based on the analysis of the sound. The instructions additionally include determining a plurality of audio elements associated with each of the plurality of audio frequencies associated with the at least one audio stream and determining at least one audio source to provide audio associated with each of the plurality of audio elements. The instructions further include controlling the at least one audio source to provide the audio associated with each of the plurality of audio elements. The at least one audio source is at least one of: at least one speaker of a vehicle and a speaker system of a portable device.

BRIEF DESCRIPTION OF THE DRAWINGS

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The disclosure itself, however, as well as a preferred mode of use, further objects and advances thereof, can be best understood by reference to the following detailed description of illustrative embodiments when read in conjunction with the accompanying drawings, wherein:

DETAILED DESCRIPTION

Figure 1:
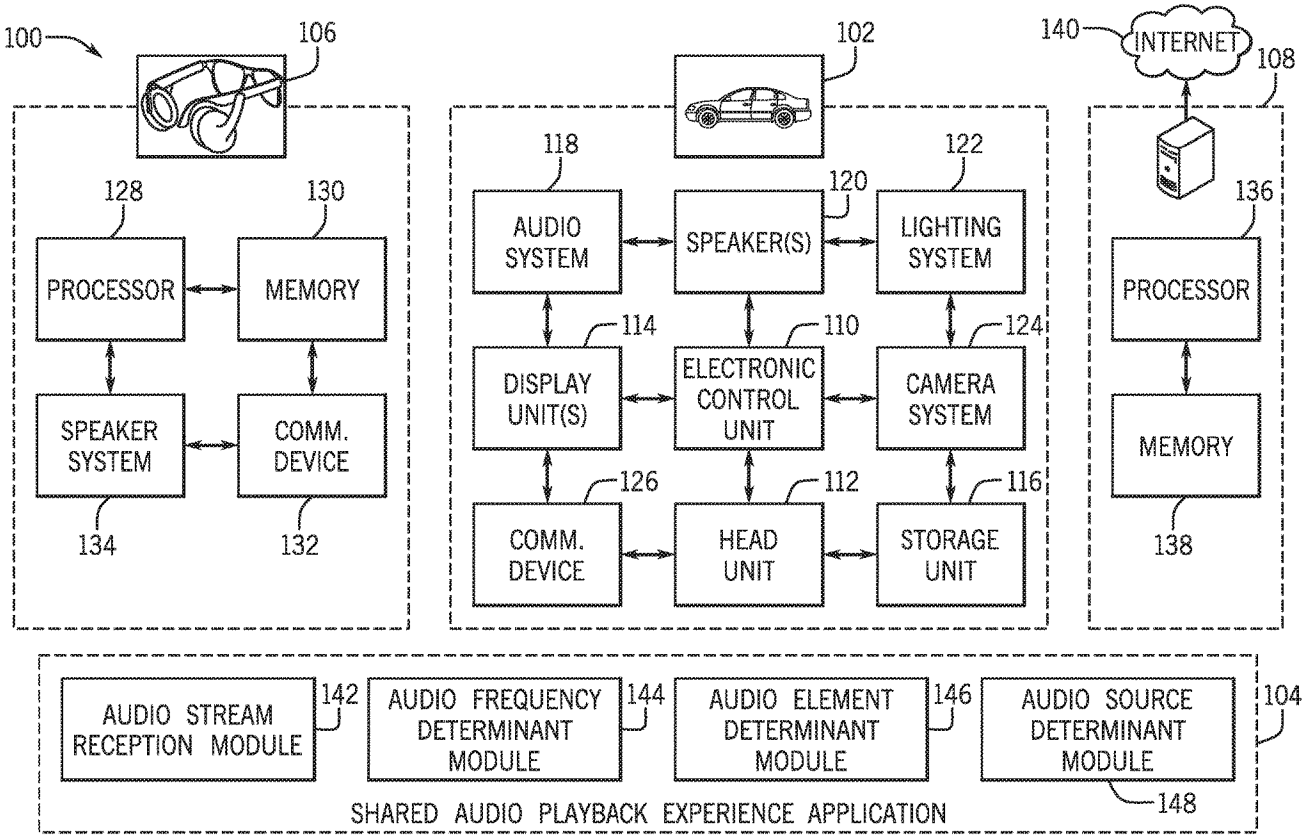
FIG. 1 is a schematic view of an exemplary operating environment of a shared audio playback experience system according to an exemplary embodiment.

The following includes definitions of selected terms employed herein. The definitions include various examples and/or forms of components that fall within the scope of a term and that can be used for implementation. The examples are not intended to be limiting.

A "bus,' as used herein, refers to an interconnected architecture that is operably connected to transfer data between computer components within a singular or multiple systems. The bus can be a memory bus, a memory controller, a peripheral bus, an external bus, a crossbar switch, and/or a local bus, among others. The bus can also be a vehicle bus that interconnects components inside a vehicle using protocols such as Controller Area network (CAN), Local Interconnect Network (LIN), among others.

"Computer communication", as used herein, refers to a communication between two or more computing devices (e.g., computer, personal digital assistant, cellular telephone, network device) and can be, for example, a network transfer, a file transfer, an applet transfer, an email, a hypertext transfer protocol (HTTP) transfer, and so on. A computer communication can occur across, for example, a wireless system (e.g., IEEE 802.11), an Ethernet system (e.g., IEEE 802.3), a token ring system (e.g., IEEE 802.5), a local area network (LAN), a wide area network (WAN), a point-to-point system, a circuit switching system, a packet switching system, among others.

An "input device" as used herein can include devices for controlling different vehicle features which are include various vehicle components, systems, and subsystems. The term "input device" includes, but it not limited to: push buttons, rotary knobs, and the like. The term "input device" additionally includes graphical input controls that take place within a user interface which can be displayed by various types of mechanisms such as software and hardware based controls, interfaces, or plug and play devices.

A "memory," as used herein can include volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

A "module", as used herein, includes, but is not limited to, hardware, firmware, software in execution on a machine, and/or combinations of each to perform a function(s) or an action(s), and/or to cause a function or action from another module, method, and/or system. A module can include a software controlled microprocessor, a discrete logic circuit, an analog circuit, a digital circuit, a programmed logic device, a memory device containing executing instructions, and so on.

An "operable connection," as used herein can include a connection by which entities are "operably connected", is one in which signals, physical communications, and/or logical communications can be sent and/or received. An operable connection can include a physical interface, a data interface and/or an electrical interface.

An "output device" as used herein can include devices that can derive from vehicle components, systems, subsystems, and electronic devices. The term "output devices" includes, but is not limited to: display devices, and other devices for outputting information and functions.

A "processor", as used herein, processes signals and performs general computing and arithmetic functions. Signals processed by the processor can include digital signals, data signals, computer instructions, processor instructions, messages, a bit, a bit stream, or other means that can be received, transmitted and/or detected. Generally, the processor can be a variety of various processors including multiple single and multicore processors and co-processors and other multiple single and multicore processor and co-processor architectures. The processor can include various modules to execute various functions.

A "vehicle", as used herein, refers to any moving vehicle that is capable of carrying one or more human occupants and is powered by any form of energy. The term "vehicle" includes, but is not limited to: cars, trucks, vans, minivans, SUVs, motorcycles, scooters, boats, personal watercraft, and aircraft. In some cases, a motor vehicle includes one or more engines.

A "vehicle system", as used herein can include, but are not limited to, any automatic or manual systems that can be used to enhance the vehicle, driving and/or safety. Exemplary vehicle systems include, but are not limited to: an electronic stability control system, an anti-lock brake system, a brake assist system, an automatic brake prefill system, a low speed follow system, a cruise control system, a collision warning system, a collision mitigation braking system, an auto cruise control system, a lane departure warning system, a blind spot indicator system, a lane keep assist system, a navigation system, a transmission system, brake pedal systems, an electronic power steering system, visual devices (e.g., camera systems, proximity sensor systems), a climate control system, an electronic pretensioning system, among others.

I. System Overview

Referring now to the drawings, wherein the showings are for purposes of illustrating one or more exemplary embodiments and not for purposes of limiting the same, FIG. 1 is a schematic view of an exemplary operating environment of a shared audio playback experience system 100 according to an exemplary embodiment of the present disclosure. The components of the system 100, as well as the components of other systems, hardware architectures and software architectures discussed herein, may be combined, omitted or organized into different architecture for various embodiments. However, the exemplary embodiments discussed herein focus on the system 100 as illustrated in FIG. 1, with corresponding system components, and related methods.

As shown in the illustrated embodiment of FIG. 1, the system 100 may include a vehicle 102 that may include one or more users of a shared audio playback experience application 104 (audio experience application) that are located within the vehicle 102 (e.g., as non-driving passengers). In some cases, the user(s) may be located outside of the vehicle 102 within a location that may include an external audio system (not shown) (e.g., home theater surround sound audio system, public speaker broadcast system) and external speakers (not shown).

As discussed in more detail below, the audio experience application 104 may be executed by the vehicle 102, a portable device 106 (e.g., wearable device) being used by each respective user of the application 104, an externally hosted server infrastructure 108 (external server), and/or the external audio system to provide a shared audio experience for the one or more users of the application 104. For purposes of simplicity this disclosure of the system 100 and the application 104 will be described with respect to one or more users using one or more portable devices 106 within an interior cabin (illustrated in FIG. 2) of the vehicle 102 and executing the application 104 to provide audio playback via the components of the vehicle 102 and the portable device(s) 106. However, it is to be appreciated that the components of the system 100 discussed below may also be used to provide audio playback via the components of the external audio system and the portable device 106. For example, the audio experience application 104 may provide a shared audio playback experience for a user(s) located outside of the vehicle 102 within a home that includes the external audio system.

As discussed in more detail below, the audio experience application 104 may allow a plurality of audio elements (e.g., that are attributable to various levels of audio frequency such as various levels of bass and various levels of treble) that may be associated with an application (e.g., third-party application) that may be executed on the portable device 106 (e.g., gaming application, virtual reality application, video playback application, and audio playback application) to be shared such that one or more of the audio elements are provided within the vehicle 102 and one or more of the audio elements are provided through the respective portable device 106 used by one or more of the users of the application 104. In particular, playback of particular audio elements may be provided (e.g., played back) within the vehicle 102 and/or through the portable device 106 to allow the user to experience a shared three-dimensional audio experience within the space of an interior cabin of the vehicle 102 that is symmetrical as heard within the vehicle 102 and through the portable device 106 (e.g., ear phones).

Additionally, as discussed below, the audio experience application 104 may control the playback of audio and/or graphical playback to allow a plurality of users of the application 104 to listen to audio associated with an audio stream (e.g., as part of a gaming experience, a video playback experience) that may be provided globally within the interior cabin of the vehicle 102, at specific locations of the interior cabin of the vehicle 102, and/or through the portable device 106. The application 104 may also be configured to control the audio and/or graphical playback to allow the plurality of the users of the application 104 to hear audio associated with a plurality of audio streams (e.g., audio files associated with numerous games being played on a plurality of portable devices 106 used by the plurality of users) that may be heard by each of the plurality of users that are seated within the vehicle 102 using a respective portable device 106.

The audio experience application 104 may allow the playback of particular audio elements from one or more audio streams to be provided within the vehicle 102 and/or through the portable device 106 to allow each of the plurality of users to experience a shared three-dimensional audio experience within the three-dimensional space of an interior cabin of the vehicle 102. In some configurations, the audio experience application 104 may additionally cancel (e.g., remove) noise to enhance the playback of particular audio elements from the one or more audio streams to be provided within the vehicle 102 and/or through the portable device 106.

With particular, reference to the vehicle 102 of the system 100, the vehicle 102 may include an electronic control unit 110 that operably controls a plurality of components of the vehicle 102. In an exemplary embodiment, the ECU 110 of the vehicle 102 may include a processor (not shown), a memory (not shown), a disk (not shown), and an input/output (I/O) interface (not shown), which are each operably connected for computer communication via a bus (not shown). The I/O interface provides software and hardware to facilitate data input and output between the components of the ECU 110 and other components, networks, and data sources, of the system 100. In one embodiment, the ECU 110 may execute one or more operating systems, applications, and/or interfaces that are associated with the vehicle 102.

In one or more configurations, the ECU 110 may be in communication with a head unit 112. The head unit 112 may include internal processing memory, an interface circuit, and bus lines (components of the head unit not shown) for transferring data, sending commands, and communicating with the components of the vehicle 102. In one or more embodiments, the ECU 110 and/or the head unit 112 may execute one or more operating systems, applications, and/or interfaces that are associated to the vehicle 102 through one or more display units 114 located within the vehicle 102.

In one embodiment, the display unit(s) 114 may be disposed within various areas of the interior cabin of the vehicle 102 (e.g., center stack area, behind seats of the vehicle 102) and may be utilized to display one or more application human interfaces (application HMI) associated with the audio experience application 104 to allow each user of the application 104 to provide one or more inputs pertaining to their respective location within the vehicle 102. As discussed below, the one or more user interfaces associated with the application 104 may be presented through the display unit(s) 114 and/or the portable device 106 used by each respective user of the application 104.

In an exemplary embodiment, the vehicle 102 may additionally include a storage unit 116. The storage unit 116 may store one or more operating systems, applications, associated operating system data, application data, vehicle system and subsystem user interface data, and the like that are executed by the ECU 110, the head unit 112, and one or more applications executed by the ECU 110 and/or the head unit 112 including the audio experience application 104.

In one or more embodiments, the storage unit 116 may be configured to store one or more executable files, that may include, but may not be limited to, one or more audio files, one or more video files, and/or one or more application files that may be accessed and executed by one or more components of the vehicle 102 and/or the portable device 106 connected to the vehicle 102. In some embodiments, the head unit 112, an audio system 118 of the vehicle 102, and/or the portable device 106 may be configured to access the storage unit 116 to access and execute the one or more executable files to provide executable applications (e.g., video games), video, and/or audio within the vehicle 102 and/or through the portable device 106.

In an exemplary embodiment, the audio system 118 may be configured to playback audio from a plurality of audio sources through one or more of a plurality of speakers 120 located within a plurality of locations of the interior cabin of the vehicle 102. The audio system 118 may communicate with one or more additional vehicle systems (not shown) and/or components to provide audio pertaining to one or more interfaces, alerts, warnings, and the like that may be accordingly provided.

In some embodiments, the audio system 118 may be configured to execute audio files stored on the storage unit 116. For example, one or more users may store one or more music files (e.g., MP3 files) of a music library on the storage unit 116 to be accessed and executed by the audio system for playback within the vehicle 102. In additional embodiments, the audio system 118 may be operably connected to a radio receiver (not shown) that may receive radio frequencies and/or satellite radio signals from one or more antennas (not shown) that intercept AM/FM frequency waves and/or satellite radio signals.

In one embodiment, the audio system 118 may be configured to receive one or more commands from one or more components of the audio experience application 104 to utilize one or more speakers 120 of the vehicle 102. As discussed below, the application 104 may utilize one or more of the speakers 120 to playback one or more audio elements of one or more audio streams derived from one or more data sources (e.g., including application files, video files, and audio files). This functionality may ensure that the audio system 118 may be used to provide the user with a shared audio experience between one or more of the speakers 120 of the vehicle 102 and/or a speaker system 134 of the portable device 106 discussed below. In other words, the application 104 allows each user to hear a plurality of audio elements that may be provided together to form the audio stream to be heard through a shared three-dimensional audio playback experience that is provided through the speakers 120 of the vehicle 102 and/or the speaker system 134 of the portable device 106.

In one or more configurations, the speakers 120 of the vehicle 102 may include, but may not be limited to, component speakers, full range speakers, tweeter speakers, midrange speakers, mid-bass speakers, a subwoofer, nose-canceling speakers and the like. It is to be appreciated that the speakers 120 may include one or more components of the aforementioned speaker types that may be provided within a single form factor. The speakers 120 may be individually configured (e.g., based on the speaker type) to provide one or more particular audio frequencies to provide an optimum listening experience to the user(s) within the vehicle 102.

For example, full range speakers and/or component speakers may be utilized to provide a generally broad (mid-low to mid-high)) range of audio frequencies, tweeter speakers may be utilized to provide a high/very high range of audio frequencies, midrange speakers may be configured to cover middle range audio frequencies, and the subwoofer may be utilized to provide a low to very low range audio frequencies. In some configurations, the application 104 may send one or more commands to the audio system 118 to utilize the speakers 120 configured as noise-cancelling speakers to emit a frequency of sound to interfere with a similar sound frequency of a particular sound(s) to reduce ambient noise within the vehicle 102.

Figure 2:
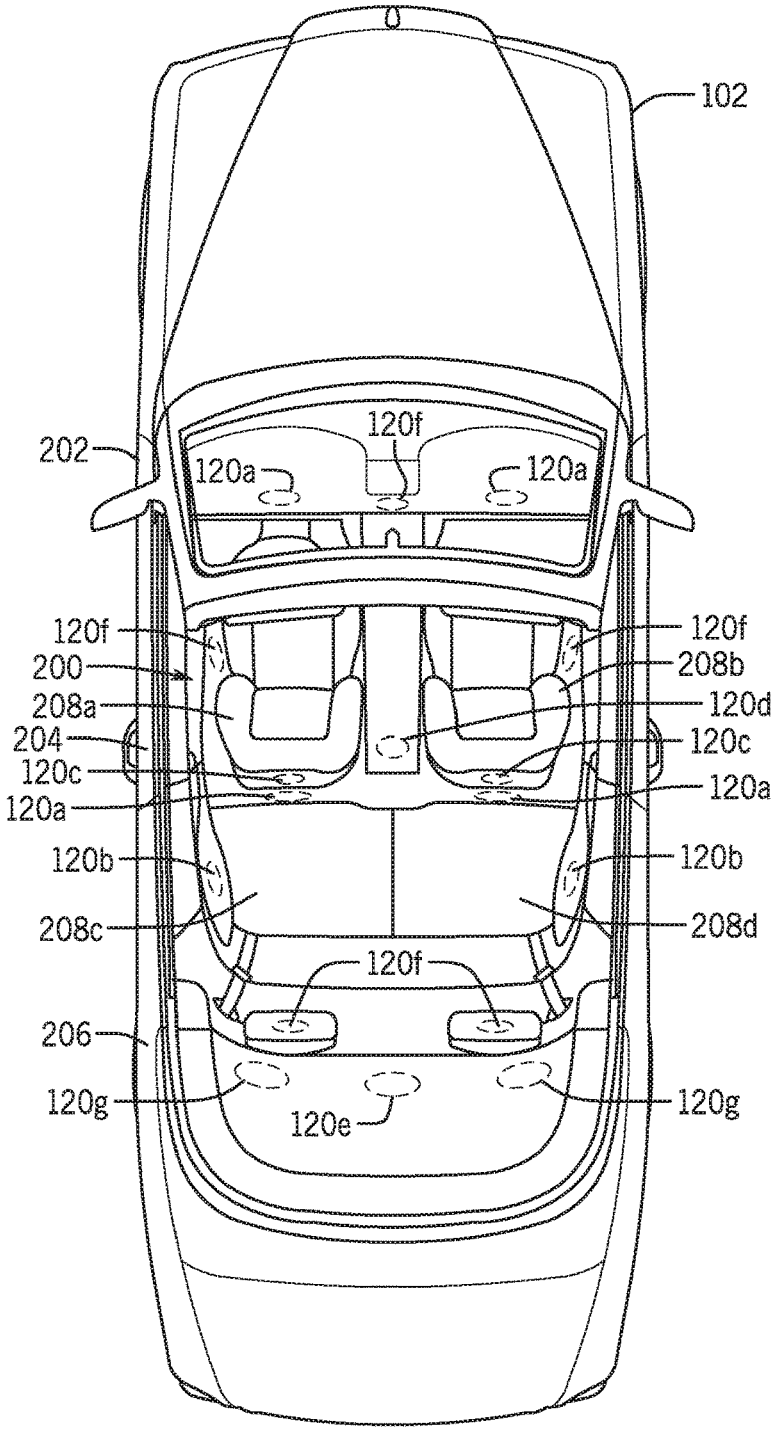
FIG. 2 is an illustrative example of various types of speakers that may be provided within a plurality of areas of an interior cabin of a vehicle according to an exemplary embodiment.

As shown in the illustrative example of FIG. 2, various types of speakers 120 may be provided within a plurality of areas of the interior cabin 200 of the vehicle 102. For example, speakers 120 configured as full range speakers 120*a* and/or component speakers 120*b* may be provided at a front portion 202 of the vehicle 102, at a middle portion 204 of the vehicle 102, at a rear portion 206 of the vehicle 102, and/or at or near one or more of the seats 208*a*-208*d* of the vehicle 102. Additionally, the speakers 120 that are configured as tweeter speakers 120*c*, midrange speakers 120*d*, mid-bass speakers 120*e*, noise-canceling speakers 120*f*, and/or subwoofers 120*g* may be provided at the front portion 202, at or near one or more of the seats 208*a*-208*d* of the vehicle 102, at the middle portion 204, and the rear portion 206 of the vehicle 102.

As discussed below, the audio experience application 104 may communicate command(s) to the audio system 118 to utilize one or more of the speakers 120 configured as particular types of speakers to provide particular audio elements of the audio stream(s) received by the application 104. The particular audio elements may be associated with one or more audio frequencies at one or more particular portions 202, 204, 206 of the vehicle 102 and/or at or near one or more of the seats 208*a*-208*d* of the vehicle 102. Consequently, one or more of the audio elements may be provided via one or more particular types of speakers 120 that are configured (e.g., best suited) to playback the particular audio frequency of the particular audio element(s).

In some embodiments, the application 104 may also determine the location of the user within the vehicle 102 to operably control one or more of the speakers 120 to playback the particular audio frequency of the particular audio element(s). Additionally, as discussed below, the audio experience application 104 may be configured to operably control the portable device 106 to provide one or more audio elements of the audio stream(s) included via the speaker system 134 of the portable device 106 to thereby provide the shared three-dimensional audio experience.

With reference again to FIG. 1, the vehicle 102 may also include a lighting system 122. The lighting system 122 may be operably connected to one or more interior lights that may include, but may not be limited to, panel lights, dome lights, floor lights, in-dash lights, in-seat lights, in-speaker lights of the vehicle 102. In some embodiments, the audio experience application 104 may communicate one or more commands to the lighting system 122 to enable or disable one or more of the interior lights of the vehicle 102 to provide an immersive visual experience that may correspond to the shared three-dimensional audio experience provided by the application 104.

The audio experience application 104 may further communicate with a camera system 124 of the vehicle 102 to determine the location(s) of the user(s) seated within the vehicle 102. In one embodiment, the camera system 124 may include one or more cameras that may be disposed at one or more locations of the interior cabin of the vehicle 102. The one or more cameras may be configured to capture images/video of each of the seats of the vehicle 102.

The camera system 124 may be configured to execute camera logic to determine the location of the user(s) using the portable device 106 within the vehicle 102. For example, the camera logic may be executed to identify one or more users that may be wearing and using respective portable devices 106 configured as wearable devices and/or holding and using one or more portable devices 106 configured as tablets with attached earphones within the vehicle 102. The camera system 124 may accordingly provide data pertaining to the location(s) of the user(s) using the portable device 106 to the audio experience application 104. In one embodiment, the application 104 may utilize such data to determine the location of the user(s) within the vehicle 102 to playback particular element(s) of an audio stream(s) via one or more particular speakers 120 of the vehicle 102.

In an exemplary embodiment, the ECU 110 and/or the head unit 112 may be operably connected to a communication device 126 of the vehicle 102. The communication device 126 may be capable of providing wired or wireless computer communications utilizing various protocols to send/receive non-transitory signals internally to the plurality of components of the vehicle 102 and/or externally to external devices such as the portable device 106 used by the user(s), and/or the external server 108. Generally, these protocols include a wireless system (e.g., IEEE 802.11 (Wi-Fi), IEEE 802.15.1 (Bluetooth®)), a near field communication system (NFC) (e.g., ISO 13157), a local area network (LAN), and/or a point-to-point system.

In one or more embodiments, the communication device 126 may be utilized to communicate with the portable device 106 that are connected to the vehicle 102 via a wireless connection (e.g., via a Bluetooth® connection). As discussed below, the audio experience application 104 may send one or more commands to the communication device 126 to send and/or receive data between the portable device 106 and the vehicle 102. For example, the application 104 may utilize the communication device 126 to receive audio data that may include one or more audio streams that are stored on the portable device 106. Additionally, the application 104 may utilize the communication device to send data pertaining to one or more audio elements of one or more particular audio streams for playback through the speaker system 134 of the portable device 106. For example, the application 104 may send one or more commands to provide particular audio elements with treble frequencies for playback via the speaker system 134 of the portable device 106 (rather than through the speakers 120 of the vehicle 102).

With particular reference to the portable device 106, the portable device 106 may include a head mounted computing display device which enables a respective user to view a virtual and/or augmented reality image from the user's point of reference. In additional embodiments, the portable device 106 may be a virtual headset, a mobile phone, a smart phone, a hand held device such as a tablet, a laptop, an e-reader, etc. The portable device 106 may include a processor 128 for providing processing and computing functions.

The processor 128 may be configured to control one or more respective components of the portable device 106. The processor 128 may additionally execute one or more applications including the audio experience application 104. The portable device 106 may include a display device(s) (e.g., head mounted optical display device, screen display) (not shown) that is operably controlled by the processor 128 and may be capable of receiving inputs from the user through an associated touchscreen/keyboard/touchpad (not shown).

The display device(s) may be utilized to present one or more application HMIs to provide the user(s) with various types of information and/or to receive one or more inputs from the user(s). In one embodiment, the application HMIs may pertain to one or more application interfaces. For example, the application HMIs may include, but may not be limited to, gaming interfaces, virtual reality interfaces, augmented reality interfaces, video playback interfaces, audio playback interfaces, web-based interfaces, application interfaces, and the like.

In one embodiment, the audio experience application 104 may control the display of one or more of the HMIs to synchronize playback of one or more audio streams to provide various audio elements from one or more of the audio streams associated with a plurality of HMIs simultaneously via the speakers 120 of the vehicle 102. For example, the application 104 may determine that two users may be viewing/interacting with two different gaming interfaces with respective unique (e.g., different with respect to each other) audio streams and may synchronize playback of one or more audio elements (e.g., present certain gaming elements at particular times) of each or both of the gaming interfaces to provide synchronized bass audio elements via the speakers 120.

In one embodiment, the processor 128 may be operably connected to a memory 130 of the portable device 106. The memory 130 may store one or more operating systems, applications, associated operating system data, application data, application user interface data, and the like that are executed by the respective processors 138*a*, 138*b* and/or one or more applications including the audio experience application 104. In one or more embodiments, the memory 130 may be configured to store one or more executable files, that may include, but may not be limited to, one or more audio files, one or more video files, and one or more application files that may be accessed and executed by one or more components of the portable device 106 and/or the vehicle 102.

The processor 128 may be configured to access the memory 130 to access and execute the one or more executable files to provide executable applications (e.g., games), video, and/or audio through the portable device 106. In some embodiments, the audio experience application 104 may be configured to access and execute the one or more executable files to control the presentation and playback of one or more visual and/or audio elements associated with executable applications, video, and/or audio that is provided to the user through the portable device 106.

In one or more embodiments, the speaker system 134 may be configured within one or more form factors that may include but may not be limited to, earbud headphones, in-ear headphones, on-ear headphones, over-the-ear headphones, wireless headphones, noise cancelling headphones, and the like. The speaker system 134 may be configured as part of a form factor of the portable device 106 (e.g., virtual reality headset with ear phones) that includes one or more speakers (not shown) of the speaker system 134. In alternate configurations, the speaker system 134 may be part of an independent form factor that is connected to the portable device 106 via a wired connection or a wireless connection. For example, the portable device 106 may be operably connected to separate ear phones that are connected via a wired or wireless connections to the portable device 106 (e.g., ear phones wirelessly connections to a tablet).

As discussed below, the audio experience application 104 may send one or more commands to the portable device 106 to playback one or more audio elements of one or more audio streams (that may be associated to a game or video or song being presented to the user(s) via the portable device 106) through the speaker system 134. The application 104 may additionally send commands to the audio system 118 of the vehicle 102 to play back one or more audio elements of the one or more of the audio streams via one or more of the speakers 120 of the vehicle 102. For example, the application 104 may evaluate an audio steam of a gaming application being executed by the portable device 106 and may send commands to utilize the speaker system 134 to playback audio elements of portions of the gaming application that include various treble frequencies. Additionally, the application 104 may send commands to utilize one or more speakers 120 of the vehicle 102 to playback audio elements of portions of the gaming application that include various bass frequencies.

With reference to the external server 108, the external server 108 may include, but may not be limited to, a data server, a web server, an application server, a collaboration server, a proxy server, a virtual server, and the like. In one embodiment, the external server 108 may include a processor 136 that may operably control a plurality of components of the external server 108. The processor 136 may include a communication unit (not shown) that may be configured to connect to an internet cloud 140 to enable communications between the external server 108, the vehicle 102, and the portable device 106.

In one embodiment, the processor 136 may be operably connected to a memory 138 of the external server 108. The memory 138 may store one or more operating systems, applications, associated operating system data, application data, executable data, and the like. In particular the memory 138 may be configured to store one or more application/executable files, that may include, but may not be limited to, one or more audio files, one or more video files, and one or more application files that may be accessed and executed by the processor 136, the ECU 110 and/or the head unit 112 of the vehicle 102, and/or the processor 128 of the portable device 106, and one or more applications executed by the processor 136 including the audio experience application 104. For example, an application file pertaining to a virtual reality game may be accessed by the portable device 106 through wireless computer communication by the communication device 132 to the internet cloud 140 for the user to play the game via the portable device 106.

In some embodiments, the memory 138 may also store one or more data libraries. The one or more data libraries may be stored by one or more web-based audio services and/or gaming services. In some configurations, the audio experience application 104 may be configured to access the one or more data libraries to evaluate one or more audio files to queue audio playback of particular audio streams (e.g., associated with songs, gaming features, visual graphics) on one or more portable devices 106 used by one or more users. In some embodiments, this functionality may enable multiple users of multiple portable devices 106 to hear a synchronized audio experience while utilizing one or more (same or different) applications through their respective portable devices 106 allow the multiple users to experience the three-dimensional audio experience within the interior cabin of the vehicle 102.

II. The Shared Audio Playback Experience Application and Related Methods

The components of the audio experience application 104 will now be described according to an exemplary embodiment and with reference to FIG. 1. In an exemplary embodiment, the audio experience application 104 may be stored on the storage unit 116 of the vehicle 102 and/or the memory 130 of the portable device 106. In additional embodiments, the audio experience application 104 may be stored on the memory 138 of the external server 108 and may be accessed by the communication device 126 to be executed by the ECU 110 and/or the head unit 112. Additionally, the application 104 stored on the memory 138 of the external server 108 may be accessed by the communication device 132 of the portable device 106 to be executed by the processor 128.

In one or more embodiments, the audio experience application 104 may include a plurality of modules that may be utilized to provide the three-dimensional shared audio experience utilizing the speakers 120 of the vehicle 102 and the speaker system 134 of the portable device 106 within the interior cabin of the vehicle 102. In an exemplary embodiment, the plurality of modules may include an audio stream reception module 142 (stream reception module), an audio frequency determinant module 144 (frequency determinant module), an audio element determinant module 146 (element determinant module), and an audio source determinant module 148 (source determinant module). It is to be appreciated that the application 104 may include one or more additional modules and/or sub-modules that are provided in addition to the modules 142-148.

In an exemplary embodiment, the stream reception module 142 may be configured to communicate with the portable device 106 to determine data pertaining to an executed (third-party) application if the user is executing an application (e.g. gaming application, video playback application, and audio playback application) on the portable device 106. The stream reception module 142 may additionally be configured receive an audio data pertaining to one or more audio streams associated with the executed application. The audio stream(s) may include one or more audio clips/segments of one or more lengths (e.g., time based) and one or more sizes (e.g., data size) that may correspond to content displayed via the display screen(s) of the portable device 106. Upon receiving the audio data pertaining to the audio stream(s), the stream reception module 142 may be configured to communicate data pertaining to the audio stream(s) to the frequency determinant module 144.

The frequency determinant module 144 may be configured to generate a sound wave(s) associated with the audio clip/segment of the audio stream(s). The sound wave(s) may include one or more oscillations that may be electronically analyzed by the frequency determinant module 144 to determine one or more audio frequencies (that may be measured in hertz). In an alternate embodiment, the module 144 may additionally electronically analyze the sound wave(s) to determine one or more amplitudes of the sound wave (that may be measured in decibels).

In an exemplary embodiment, upon determining the plurality of frequencies, the frequency determinant module 144 may communicate data pertaining to the plurality of audio frequencies to the element determinant module 146. The element determinant module 146 may be configured to electronically analyze the plurality of audio frequencies and determine one or more portions of the audio stream(s) (e.g., one or more segments of audio) that include particular audio frequencies that pertain to particular audio elements.

As discussed in more detail below, if more than one audio stream is received by the audio stream reception module 142 based on more than one user utilizing the portable device 106 to execute a particular application or various applications, the element determinant module 146 may be configured to electronically analyze the plurality of audio frequencies from each of the plurality of audio streams and determine one or more portions of each of the plurality of audio streams that include one or more audio elements that are within one or more frequency similarity thresholds (e.g., ranges of frequencies).

In an exemplary embodiment, the element determinant module 146 may communicate data pertaining to the plurality of audio elements from one or more audio streams based on the analysis of the respective audio frequencies to the source determinant module 148. The source determinant module 148 may be configured to analyze the plurality of audio elements and determine at least one audio source to provide audio associated with each of the plurality of audio elements. In one configuration, if a plurality of audio streams are received by the application 104, the source determinant module 148 may further determine playback synchronization of the one or more audio elements (e.g., bass) of the plurality of audio streams through one or more of the speakers 120 of the vehicle 102 as a plurality of users utilize respective portable devices 106 to execute respective applications.

In an exemplary embodiment, the source determinant module 148 may determine one or more of the speakers 120 of the vehicle 102 and/or the speaker system 134 of the portable device 106 that are to be utilized to provide the audio associated with each of the plurality of audio elements of the plurality of audio streams. As discussed below, the source determinant module 148 may analyze additional data such as data pertaining to the seated location of each user and/or may evaluate the configuration of one or more speakers 120 of the vehicle 102 to determine the one or more speakers of the vehicle 102 that may be utilized to playback one or more of the plurality of audio elements of the audio stream(s).

In an exemplary embodiment, the source determinant module 148 may communicate with the audio system 118, the ECU 110 of the vehicle 102, the speaker system 134, and/or the processor 128 of the portable device 106 to operably control one or more of the speakers 120 of the vehicle 102 and the speaker system 134 to provide the audio associated with each of the plurality of audio elements of the audio stream(s) associated with the executed application(s) on the portable device 106.

Figure 3:
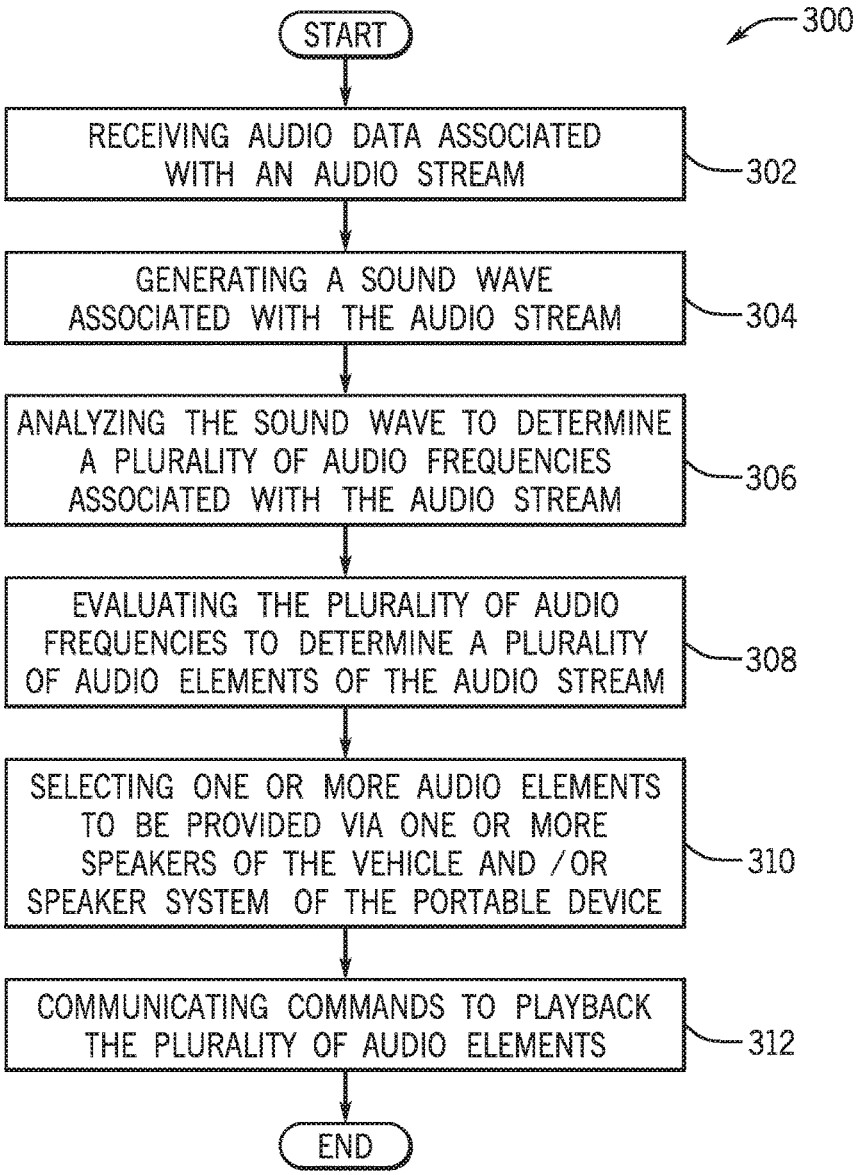
FIG. 3 is a process flow diagram of a method for providing a shared audio experience during playback of a single audio stream within the vehicle according to an exemplary embodiment.

FIG. 3 is a process flow diagram of a method 300 for providing a shared audio experience during playback of a single audio stream within a vehicle 102 according to an exemplary embodiment. FIG. 3 will be described with reference to the components of FIG. 1 though it is to be appreciated that the method of FIG. 3 may be used with other systems and/or components. The method 300 may begin at block 302, wherein the method 300 may include receiving audio data associated with an audio stream.

In an exemplary embodiment, the stream reception module 142 may be configured to communicate with the processor 128 of each portable device 106 that executes the application 104 and/or is wirelessly connected to the vehicle 102 (e.g., via a Bluetooth connection between the communication device 126 and the communication device 132). Upon communicating with the processor 128 of each portable device 106, the stream reception module 142 may determine when a particular portable device 106 executes a particular application (e.g., third-party application). As discussed above, one or more applications include, but not limited to, gaming applications, video playback applications, and audio playback applications.

Upon determining when the portable device 106 executes a particular application, the processor 128 of the portable device 106 may communicate data that is associated with the particular (executed) application that includes an audio stream to the stream reception module 142. In particular, the processor 128 of the portable device 106 may be configured to communicate audio data associated with an audio stream (or a plurality of audio streams which are each analyzed via execution of the method 300) included as part of a particular application that may be retrieved from the memory 130 of the portable device 106, the storage unit 116 of the vehicle 102, and/or the memory 138 of the external server 108.

Consequently, the stream reception module 142 may receive the audio data associated with the audio stream. As discussed above, the audio stream may include one or more audio clips of one or more lengths and one or more sizes that may correspond to the content display via the display screen of the portable device 106. For example, for a gaming application, the audio stream may include one or more audio elements that are included as part of one or more sound graphics, music, narration, and/or audio attributes of a particular game.

The method 300 may proceed to block 304, wherein the method 300 may include generating a sound wave associated with the audio stream. In an exemplary embodiment, upon receiving the audio data pertaining to the audio stream, the stream reception module 142 may be configured to communicate data pertaining to the audio stream to the frequency determinant module 144. Upon receiving the data pertaining to the audio stream, the frequency determinant module 144 may evaluate the audio data pertaining to the audio stream and may generate a sound wave associated with the audio stream.

In particular, the frequency determinant module 144 may evaluate a plurality of segments of the audio stream to generate the sound wave that is associated with the audio stream. The sound wave may include one or more oscillations that are attributed to associated values (Hz values) that may be stored by the frequency determinant module 144 on the storage unit 116, the memory 130, and/or the memory 138. In some embodiments, the generated sound wave may be presented to the user via the head unit 112 and/or the portable device 106 to graphically depict the sound wave.

The method 300 may proceed to block 306, wherein the method 300 may include analyzing the sound wave to determine a plurality of audio frequencies associated with the audio stream. In one embodiment, the one or more oscillations of the generated sound wave may be electronically analyzed by the frequency determinant module 144 to determine the plurality of audio frequencies associated with the audio stream. In particular, the frequency determinant module 144 may analyze each predetermined portion associated to a period of time of the sound wave to determine a number of oscillations per second at each of the predetermined portions of the sound wave. Based on the determination of the number of oscillations per second, the frequency determinant module 144 may determine and output a plurality of frequencies that are each attributable to particular segments of the audio stream.

The method 300 may proceed to block 308, wherein the method 300 may include evaluating the plurality of audio frequencies to determine a plurality of audio elements of the audio stream. In an exemplary embodiment, upon determining the plurality of frequencies, the frequency determinant module 144 may communicate data pertaining to the plurality of audio frequencies to the element determinant module 146. The element determinant module 146 may be configured to electronically analyze the plurality of audio frequencies and determine one or more portions of the audio stream(s) (e.g., one or more segments of audio) that include particular audio frequencies that pertain to particular audio elements.

In one embodiment, the element determinant module 146 may analyze each of the plurality of frequencies that fall within a human hearing bandwidth (e.g., of 20 Hz-20400 Hz) and may determine the plurality of audio elements from one or more portions of the audio stream. More specifically, one or more of the plurality of audio elements may be determined by analyzing frequency (Hz) measurements of each of the plurality of frequencies against a plurality of frequency range threshold values to determine the plurality of audio elements.

In particular, the module 144 may analyze each of the plurality of frequencies in comparison to the frequency range threshold values to determine audio elements that may include, but may not be limited to, a Low-Bass audio element that may include frequency range threshold values of 20 Hz-40 Hz, a Mid-Bass audio element that may include frequency range threshold values of 40 Hz-80 Hz, an Upper-Bass audio element that may include frequency range threshold values of 80 Hz-160 Hz, a Lower Midrange audio element that may include frequency range threshold values of 160 Hz-320 Hz, a Middle Midrange audio element that may include frequency range threshold values of 320 Hz-640 Hz, an Upper Midrange audio element that may include frequency range threshold values of 640 Hz-1280 Hz, a Lower Treble audio element that may include frequency range threshold values of 1280 Hz-2560 Hz, a Middle Treble audio element that may include frequency range threshold values of 2560 Hz-5120 Hz, an Upper Treble audio element that may include frequency range threshold values of 5120 Hz-10200 Hz, and a Top Octave audio element that may include frequency range threshold values of 10200 Hz-20400 Hz. It is to be appreciated that the element determinant module 146 may analyze each of the plurality of frequencies of the audio stream using one or more alternate and/or additional frequency range threshold values that may pertain to one or more additional and/or alternate audio elements.

In one or more embodiment, upon analyzing the plurality of frequencies in comparison to the frequency range threshold values, the element determinant module 146 may be configured to determine and output a plurality of audio elements associated with each of the plurality of audio frequencies associated with the audio stream. In some embodiments, the element determinant module 146 may tag each of the audio elements with a timestamp that pertains to the timing of each of the audio elements within the playback of the audio stream.

Additionally, the element determinant module 146 may also tag each of the plurality of audio elements with respective descriptors that may pertain to types of sounds that may be associated with each of the plurality of audio elements. The respective descriptors may include, but may not be limited to, vocal, musical, sound graphic, sound effect, and the like that may pertain to the type of sound that is associated with each particular audio element. For example, a particular 'upper midrange audio element' may be determined to be played back at a 2 minute, 34 second time stamp (2:34) and may be tagged with a description of 'musical' that may allow the application 104 to further determine an appropriate audio source to playback the particular audio upper midrange audio element.

The method 300 may proceed to block 310, wherein the method 300 may include selecting one or more audio elements to be provided via one or more of the speakers 120 of the vehicle 102 and/or the speaker system 134 of the portable device 106. In an exemplary embodiment, upon determining the plurality of audio elements and tagging each of the plurality of audio elements with a respective descriptor, the element determinant module 146 may communicate respective data to the source determinant module 148. In one embodiment, upon receiving the data pertaining to the plurality of audio elements, the source determinant module 148 may analyze each of the plurality of audio elements to determine one or more audio elements that are to be provided via one or more of the speakers 120 of the vehicle 102. Additionally, the source determinant module 148 may determine one or more alternate audio elements of the plurality of audio elements to be provided via the speaker system 134 of the portable device 106.

In one embodiment, the source determinant module 148 may be configured to utilize the speakers 120 of the vehicle 102 to playback one or more particular audio elements of the plurality of audio elements of the audio stream. For example, the source determinant module 148 may be configured to utilize the speakers 120 of the vehicle 102 to playback the Low-Bass audio element, the Mid-Bass audio element, and the Upper-Bass audio element. Accordingly, the source determinant module 148 may select one or more of the one or more of the aforementioned (bass) audio elements to be provided by one or more of the speakers 120 of the vehicle 102.

Upon selecting one or more of the plurality of audio elements to be provided via the one or more of the speakers 120, the source determinant module 148 may select the one or more additional (e.g., alternate) audio elements of the audio stream to be provided via the speaker system 134 of the portable device 106. For example, if the audio stream also includes Middle Midrange audio elements and Upper Midrange audio elements, the source determinant module 148 may select the aforementioned (midrange) audio elements to be provided via the speaker system 134 of the portable device 106.

In another embodiment, the source determinant module 148 may analyze the plurality of audio elements and tagged descriptions and may determine one or more audio elements that may be best suited to be provided by one or more particular speakers 120 of the vehicle 102. In other words, the module 148 may determine one or more audio elements that may be provided by one or more particular speakers 120 that are specifically configured to provide the particular audio element(s). For example, with reference to FIG. 2, the source determinant module 148 may determine that the mid-bass speakers 120*e* and the subwoofers 120*g* are specifically configured to provide the Low Bass audio element that is described as musical, the Mid Bass audio element that is described as a sound effect, and the Upper Bass audio element that is described as vocal and may accordingly select one or more of these audio elements to be provided by one or both of the mid-bass speakers 120*e* and the subwoofers 120*g*. Additionally, the source determinant module 148 may determine that one or more additional audio elements be provided by the speaker system 134 of the portable device 106.

In a further embodiment, the source determinant module 148 may additionally analyze the plurality of audio elements and tagged descriptions and may determine one or more audio elements that may be best suited to be provided by one or more particular speakers 120 that are in a proximity of the seat of the vehicle 102 in which the user is seated. The source determinant module 148 may be configured to communicate with the camera system to execute camera logic to determine the location of the user using the portable device 106 within the vehicle 102. For example, the camera logic may be executed to identify one or more users that may be wearing and using respective wearable devices and/or holding and using one or more tablets with attached earphones within the vehicle 102.

The camera system 124 may accordingly provide data pertaining to the location(s) of the user(s) using the portable device(s) 106 to the source determinant module 148. In one configuration, the source determinant module 148 may utilize such data to determine the location of the user(s) within the vehicle 102 to playback one or more particular audio elements of the audio stream via one or more particular speakers 120 of the vehicle 102.

As an illustrative example, with reference to FIG. 2, the source determinant module 148 may determine that the user is seated within the seat 208*d* of the vehicle 102. The module 148 may further determine that the subwoofer 120*g* located directly behind the seat 208*d* may be configured to provide the Low Bass audio element, the Mid Bass audio element, and the Upper Bass audio element all described as musical and may accordingly select those audio elements to be provided by the particular subwoofer 120*g*. The module 148 may also determine that the full range speaker 120*a* and the component speaker 120*b* located adjacent to the seat 208*b* may be configured to provide a Middle Midrange audio element of the audio stream and may select the Middle Midrange audio element to be provided by the particular speakers 120*a*, 120*b*. Additionally, the source determinant module 148 may determine that one or more additional audio elements be provided by the speaker system 134 of the portable device 106.

In one configuration, the source determinant module 148 may also be configured to sense a level of ambient noise (e.g., engine noise, exterior road noise) that may be present within the interior cabin of the vehicle 102. Upon determining the level of ambient noise, the source determinant module 148 may determine a particular level of noise canceling (to assist in cancelling out the ambient noise) that may be provided by the speakers of the vehicle 102 and/or the speaker system 134 of the portable device 106 to enhance the listening experience of one or more audio elements being played back to the user. For example, with reference to FIG. 2, the source determinant module 148 may determine a level of ambient noise within the interior cabin 200 of the vehicle 102 and may determine that one or more noise-canceling speakers 120*f* (e.g., that may be based on the seated location of the user) in addition to the speaker system 134 of the portable device 106 that may be utilized to provide a particular level of noise cancelling within the vehicle 102.

In yet some additional embodiments, the source determinant module 148 may also be configured to sense the level of additional playback audio being played back (e.g., radio) within the vehicle 102 via the audio system 118. The source determinant module 148 may be configured to determine one or more audio elements associated with the additional playback audio and may determine one or more matching audio elements from the plurality of audio elements of the audio stream (as determined and communicated to the source determinant module 148 by the element determinant module 146).

The source determinant module 148 may be further configured to mute (e.g., remove) one or more particular audio elements from the audio stream such that those audio elements are not played back via the speakers 120 of the vehicle 102 and/or the speaker system 134 of the portable device 106. Consequently, such audio elements may be replaced with the matching audio elements included within the additional playback audio to provide the user with a seamless audio experience that blends audio from the audio stream with the additional playback audio.

In a further embodiment, the source determinant module 148 may be configured to determine the plurality of audio elements of the additional playback audio being played back (e.g., radio) within the vehicle 102 via the audio system 118. The source determinant module 148 may be configured to evaluate the audio stream and/or application data pertaining to graphics/images/video that are associated with the audio stream (e.g., to be presented to the user via the portable device 106).

The source determinant module 148 may also be configured to control playback of one or more portions of the audio stream and/or one or more portions of the graphics/images/video that are associated with the audio stream to be provided by the speakers 120 of the vehicle 102, the speaker system 134 of the portable device 106, the display device(s) of the portable device 106, and/or the display unit(s) of the vehicle 102. This functionality may allow the synchronization of the playback of one or more audio elements with the playback of one or more audio elements of the additional playback audio to provide a seamless global visual and audio experience for the user. For example, the module 148 may control the playback of various gaming elements of a gaming application that is executed through the portable device 106 such that the user is provided with particular audio elements at particular times that match with one or more audio elements of the additional playback audio being played back within the vehicle 102.

In one configuration, the source determinant module 148 may change a playback speed and/or pitch of the audio stream to be played back via one or more of the speakers 120 of the vehicle 102 and/or the speaker system 134 of the portable device 106 in order to provide a seamless audio experience that synchronizes the playback of the audio stream with the playback of the additional playback audio being played back within the vehicle 102.

The method 300 may proceed to block 312, wherein the method 300 may include communicating commands to playback the plurality of audio elements. In an exemplary embodiment, upon selecting the one or more audio elements to be provided via one or more of the speakers 120 of the vehicle 102 and the speaker system 134 of the portable device 106, the source determinant module 148 may communicate commands to playback one or more of the selected plurality of audio elements through one or more of the speakers 120 and one or more of the alternate or additional audio elements selected by the module 148 to be played back through the speaker system 134.

More specifically, the source determinant module 148 may communicate one or more respective commands to the audio system 118, the ECU 110, and/or the head unit 112 of the vehicle 102 to utilize one or more of the speakers 120 of the vehicle 102 to playback the one or more audio elements of the plurality of audio elements of the audio stream as selected by the source determinant module 148. Additionally, the source determinant module 148 may communicate one or more respective commands to the processor 128 and/or the speaker system 134 of the portable device 106 to playback one or more alternate or additional audio elements of the plurality of audio elements of the audio stream as selected by the source determinant module 148.

As an illustrative example, the source determinant module 148 may send one or more commands to the audio system 118 of the vehicle 102 to playback one or more audio elements that include bass audio elements of the audio stream (the bass of the audio stream) via one or more of the speakers of the vehicle 102. Furthermore, the module 148 may send one or more commands to the speaker system 134 to playback one or more alternate/additional audio elements that include treble audio elements of the audio stream (the treble of the audio stream) via the speaker system 134 to be provided via the portable device 106 (e.g., headphones) to the user. This functionality may allow the user to experience a shared three-dimensional audio experience by allowing the user to feel an enhanced sound and vibration of the bass of the audio stream within the interior cabin of the vehicle 102 while hearing the treble of the audio stream via the headphones of the portable device 106.

In some embodiments, the source determinant module 148 may also communicate one or more commands to the processor 128 of the portable device 106 to control the playback the one or more audio elements in one or more speeds or pitches and/or one or more portions of graphics/images/video in one or more speeds. Additionally, the source determinant module 148 may communicate one or more commands to the lighting system 122 of the vehicle 102 to enable or disable one or more of the interior lights of the vehicle 102 to provide an immersive visual experience that may correspond to the shared three-dimensional audio experience provided by the application 104.

Figure 4A:
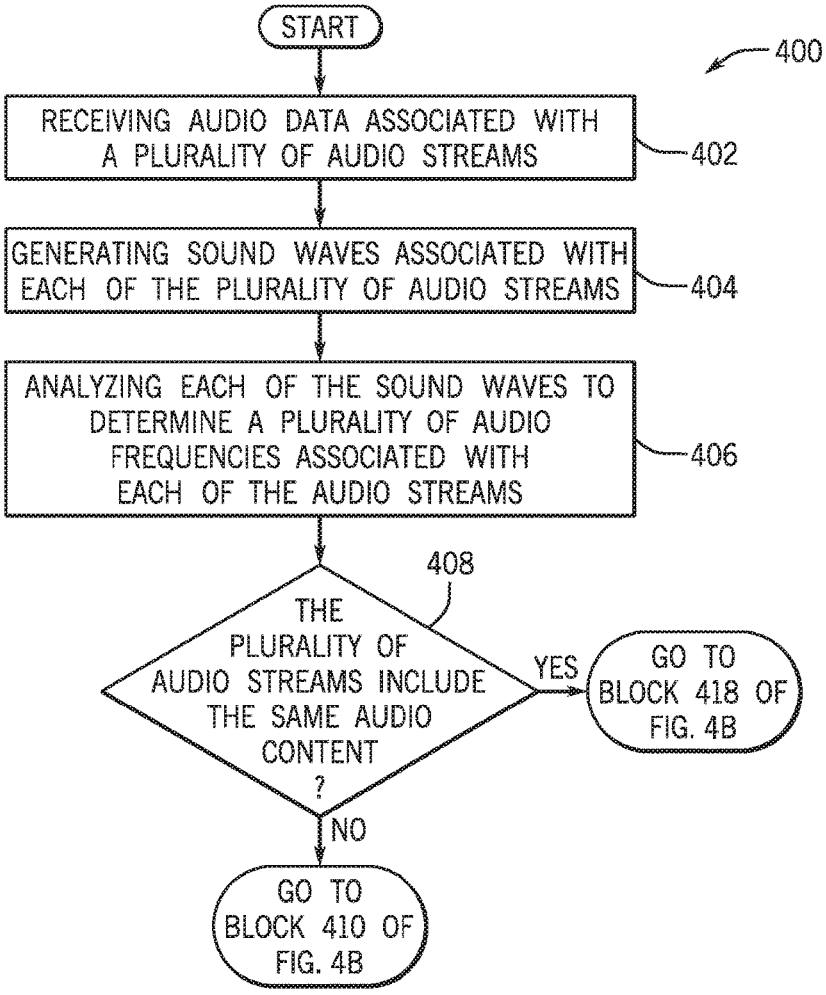
FIG. 4A is a first process flow diagram of a method for providing a shared audio experience during playback of a plurality of audio streams within the vehicle that is executed by the audio experience application according to an exemplary embodiment.

FIG. 4A is a first process flow diagram of a method 400 for providing a shared audio experience during playback of a plurality of audio streams within a vehicle 102 according to an exemplary embodiment. FIG. 4A will be described with reference to the components of FIG. 1 though it is to be appreciated that the method of FIG. 4A may be used with other systems and/or components. The method 400 may begin at block 402, wherein the method 400 may include receiving audio data associated with a plurality of audio streams.

In an exemplary embodiment, the stream reception module 142 may be configured to communicate with the processor 128 of each portable device 106 that executes the application 104 and/or is wirelessly connected to the vehicle 102 (e.g., via a Bluetooth connection between the communication device 126 and the communication device 132). Upon communicating with the processor 128 of each portable device 106, the stream reception module 142 may determine that a plurality of portable devices 106 used by a plurality of users execute various applications that may include, but may not be limited to, gaming applications, video playback applications, and audio playback applications.

Upon determining that a plurality of portable devices 106 executes various applications, the processors 128 of the respective portable devices 106 may communicate data that is associated with the respective application that is being executed that includes an audio stream to the stream reception module 142. In particular, the processors 128 of each of the respective portable devices 106 may be configured to communicate audio data that is associated with a respective audio stream included within the respective application that may be retrieved from the memory 130 of the respective portable device 106, the storage unit 116 of the vehicle 102, and/or the memory 138 of the external server 108. Consequently, the stream reception module 142 may receive the audio data associated with the plurality of audio streams.

The method 400 may proceed to block 404, wherein the method 400 may include generating sound waves associated with each of the plurality of audio streams. In an exemplary embodiment, upon receiving the audio data pertaining to the plurality of audio streams associated with respective applications executed on the plurality of portable devices 106, the stream reception module 142 may be configured to communicate data pertaining to each of the plurality of audio streams to the frequency determinant module 144. Upon receiving the data pertaining to each respective audio stream, the frequency determinant module 144 may evaluate the audio data pertaining to the respective audio stream and may generate a respective sound wave associated with each of the plurality of audio streams.

The generated sound waves may include one or more oscillations that may include associated values that may be stored by the frequency determinant module 144 on the storage unit 116 of the respective portable device 106 (that is executing the application associated with the respective audio stream), the memory 130 of the vehicle 102, and/or the memory 138 of the external server 108. In some embodiments, the respective generated sound wave associated with each of the plurality of audio streams may be presented to each of the plurality of users via the head unit 112 and/or the portable device 106 to graphically depict the respective sound wave.

The method 400 may proceed to block 406, wherein the method 400 may include analyzing each of the sound waves to determine a plurality of audio frequencies associated with each of the audio streams. In one embodiment, the one or more oscillations of the generated sound waves may be electronically analyzed by the frequency determine module 144 to determine the plurality of audio frequencies associated with each of the plurality of audio streams. In particular, the frequency determinant module 144 may analyze each predetermined portion associated to a period of time of each sound wave to determine a number of oscillations per second at each of the predetermined portions of each sound wave. Based on the determination of the number of oscillations per second, the frequency determinant module 144 may determine and output a plurality of frequencies that are each attributable to particular segments of each of the plurality of audio streams.

The method 400 may proceed to block 408, wherein the method 400 may include determining if the plurality of audio streams include the same audio content. In an exemplary embodiment, upon determining the plurality of frequencies of each of the plurality of audio streams, the frequency determinant module 144 may communicate data pertaining to the plurality of audio frequencies to the element determinant module 146. In one embodiment, the element determinant module 146 may be configured to electronically analyze the plurality of frequencies from each of the plurality of audio streams to determine a plurality of audio elements associated with each respective audio stream. As discussed in more detail above (with respect to block 308 of the method 300), one or more of the plurality of audio elements may be determined by analyzing frequency (Hz) measurements of each of the plurality of frequencies against a plurality of frequency range threshold values to determine the plurality of audio elements.

Upon determining the plurality of audio elements, the element determinant module 146 may compare a frequency value (Hz value) associated with each of the plurality of audio elements from the plurality of audio streams against one another. In particular, the module 146 may compare frequency values associated with various portions (e.g., particular timestamps of the audio stream) of each of the plurality of audio elements from a particular audio stream against frequency values associated with various matching portions (e.g., matching with respect to time) of additional audio streams (of the plurality of audio streams) (e.g., comparing the matching portions of the plurality of audio streams at various timestamps) to determine if there at least a predetermined number of frequency value matches. The predetermined number of frequency value matches may include a number of matches at one or more portions of the plurality of audio streams that may indicate that the plurality of audio streams include the same audio content.

In one embodiment, upon comparing the frequency values of each of the plurality of audio elements of each of the plurality of audio streams against one another, if the element determinant module 146 determines that there is at least a predetermined number of frequency matches, the element determinant module 146 may determine that the plurality of audio streams include the same audio content. Alternatively, if the element determinant module 146 determines that there is not at least a predetermined number of frequency matches, the element determinant module 146 may determine that the plurality of audio streams do not include the same audio content.

As an illustrative example, a first audio stream and a second audio stream are received by the stream reception module 142 based on two users executing a particular gaming application on their respective portable devices 106. Upon receiving the plurality of audio frequencies associated with each of the audio streams, the element determinant module 146 may further determine the plurality of audio elements of each of the respective audio streams. The element determinant module 146 may further compare frequency values associated with various portions of each of the plurality of audio elements of the first audio stream against frequency values associated with various matching portions of each of the plurality of audio elements of the second audio stream to determine if there are at least a predetermined number of frequency value matches. If the element determinant module 146 determines that there are at least the predetermined number of frequency matches between the first audio stream and the second audio stream, the element determinant module 146 may determine that the plurality of audio streams include the same audio content. This determination may indicate that both users are executing the same gaming application and maybe playing a shared session of a particular (same) game.

Figure 4B:
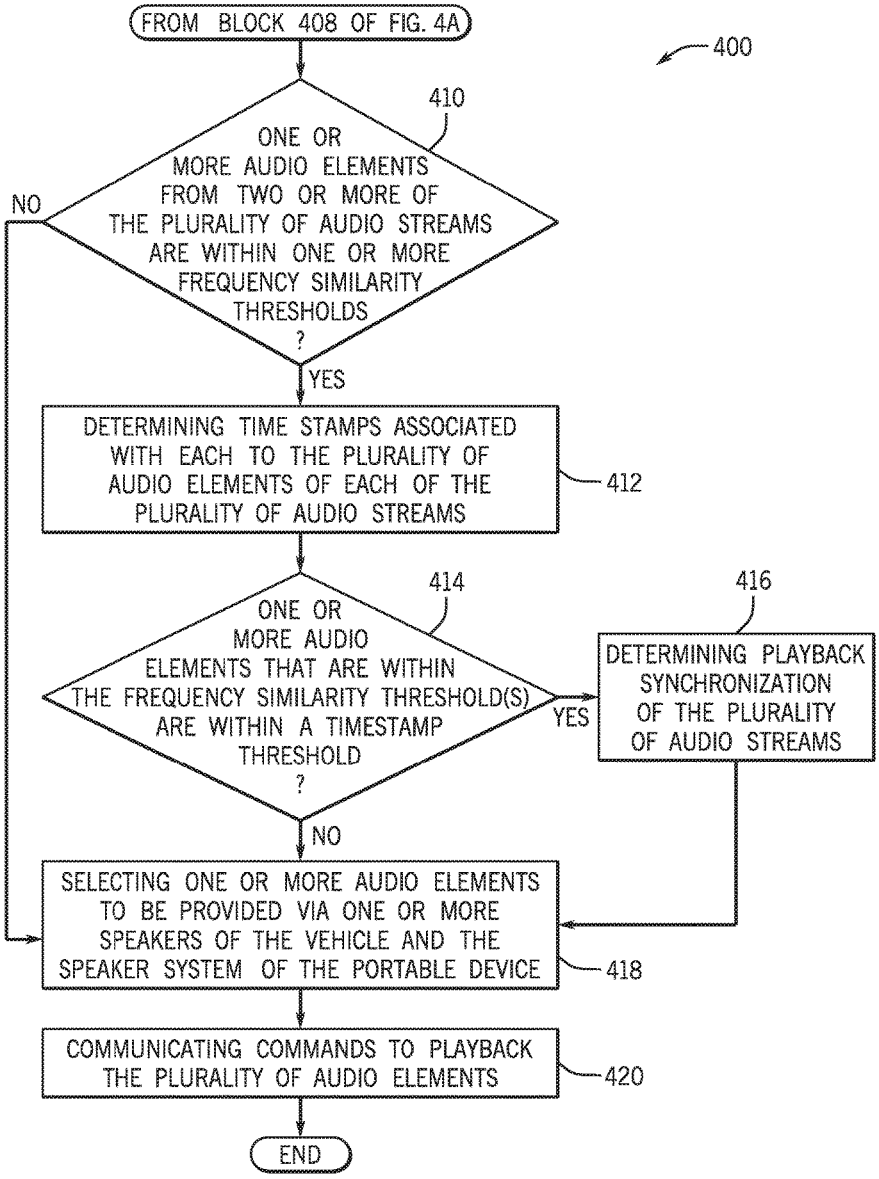
FIG. 4B is a second process flow diagram of the method for providing the shared audio experience during playback of the plurality of audio streams within the vehicle that is executed by the audio experience application according to an exemplary embodiment.

FIG. 4B is a second process flow diagram of the method 400 for providing the shared audio experience during playback of a plurality of audio streams within the vehicle 102 according to an exemplary embodiment. FIG. 4B will be described with reference to the components of FIG. 1 though it is to be appreciated that the method of FIG. 4B may be used with other systems and/or components.

If it is determined that the plurality of audio streams does not include the same audio content (at block 408 of FIG. 4A), the method 400 may proceed to block 410, wherein the method 400 may include determining if one or more audio elements from two or more of the plurality of audio streams are within one or more frequency similarity thresholds. In one embodiment, the frequency similarity thresholds utilized by the element determinant module 146 may include a plurality of ranges of frequency values that may pertain to a similar frequency range (e.g., with a similar frequency value) of one or more audio elements. For example, a frequency similarity threshold may include a range of 30 Hz-60 Hz that may include higher levels of the Low Bass audio element and lower levels of the Mid Bass audio element. In one configuration, the element determinant module 146 may evaluate the plurality of audio elements from each of the plurality of audio streams and may determine if one or more audio elements from two or more audio streams that are within one or more frequency similarity thresholds.

If it is determined that one or more audio elements from two or more audio streams are within the one or more frequency similarity threshold values, the method 400 may proceed to block 412, wherein the method 400 may include determining timestamps associated with each of the plurality of audio elements of each of the plurality of audio streams. In an exemplary embodiment, upon determining that the plurality of audio streams do not include the same audio content (e.g., that both audio streams include unique/different sound waves) and upon determining that one or more audio elements from two or more audio streams are within the one or more frequency similarity thresholds, the element determinant module 146 may determine a timestamp associated with each of the plurality of audio elements of each of the plurality of audio streams. The timestamp associated with each of the plurality of audio elements may pertain to the timing of each of the audio elements within the playback of the audio stream.

Upon determining the timestamp associated with each of the plurality of audio elements, the element determinant module 146 may tag each of the plurality of audio elements of each of the plurality of audio streams with a particular timestamp that pertains to the playback timing of the respective audio element. For example, a timestamp for a particular 'upper midrange audio element' of one audio stream may be determined to be played back at a 2 minute, 34 second time stamp, and may be tagged with a '2:34' timestamp that may allow the application 104 to further analyze the plurality of audio streams that include unique/different audio content (e.g., plurality of audio streams from a plurality of different video games applications being executed on a plurality of portable devices 106 by a plurality of users).

The method 400 may proceed to block 414, wherein the method 400 may include determining if one or more audio elements that are within the frequency similarity threshold(s) are within a timestamp threshold. In one embodiment, the element determinant module 146 may utilize a timestamp threshold as a period of time (e.g., 500 ms) at which two or more of the audio elements that are within the frequency similarity threshold(s) may be played back with respect to one another. For example, the timestamp threshold may include a period of time at which two mid-bass audio elements from two different audio streams may be played back within a 500 millisecond span of one another if both of the audio streams are simultaneously played back.

In an exemplary embodiment, the element determinant module 146 may electronically analyze each of the timestamps tagged with each of the one or more audio elements that are within the frequency similarity threshold(s) to determine if the two or more audio elements from two or more audio streams may be played back within the timestamp threshold. If the module 146 determines that one or more of the audio elements from two or more of the audio streams may be played back within the time span of the timestamp threshold, the module 146 may thereby determine that the one or more audio elements that are within the frequency similarity threshold(s) are also within the timestamp threshold.

In other words, the element determinant module 146 may determine that the one or more audio elements (e.g., mid-bass from two or more audio streams) may be played back within a time span of the timestamp threshold if the two or more audio streams are simultaneously played back. Alternatively, if the element determinant module 146 determines that one or more of the audio elements from two or more of the audio streams may not be played back within the time span of the timestamp threshold, the module 146 may thereby determine that the one or more audio elements are not within the timestamp threshold.

If it is determined that the one or more audio elements that are within the frequency similarity threshold(s) are within the timestamp threshold (at block 414), the method 400 may proceed to block 416, wherein the method 400 may include determining playback synchronization of the plurality of audio streams. In an exemplary embodiment, upon determining the plurality of audio elements and tagging each of the plurality of audio elements with the timestamp and descriptor, the element determinant module 146 may communicate respective data to the source determinant module 148. In one embodiment, upon receiving the data pertaining to the plurality of audio elements, the source determinant module 148 may analyze the plurality of audio elements from the plurality of audio sources that are within the timestamp threshold, as communicated by the element determinant module 146.

In one embodiment, the source determinant module 148 may be configured to determine playback synchronization of the two or more audio streams that include the one or more audio elements that are within the timestamp threshold (as determined at block 414). More specifically, the source determinant module 148 may be configured to evaluate the plurality of audio streams and/or application data pertaining to graphics/images/video that are associated with each of the plurality of audio streams (e.g., to be presented to the plurality of users via the display device(s) of the respective portable device 106).

The source determinant module 148 may also be configured to determine and further control playback synchronization of one or more portions of the plurality of audio streams and/or one or more portions of the graphics/images/video based on the timestamps associated with each of plurality of audio elements from the plurality of audio sources that are within the timestamp threshold. This functionality may allow the synchronization of the playback of one or more audio elements from at least one audio stream with the playback of one or more audio elements of one or more additional audio streams of the plurality of audio streams to provide a seamless global visual and audio experience for the plurality of users.

In one configuration, the source determinant module 148 may additionally change a playback speed and/or pitch of one or more portions of each of the plurality of audio streams to facilitate the playback synchronization of the plurality of audio streams. The change in playback speed and/or pitch may be applied to synchronize the playback of one or more audio elements from two or more of the audio streams that may be played back within the time span of the timestamp threshold. In another configuration, the source determinant module 148 may also change the playback speed of one or more portions of graphics/images/video to provide the seamless global visual and audio experience.

If it is determined that the plurality of audio streams includes the same audio content (at block 408 of FIG. 4A), or one or more audio elements are not within one or more frequency thresholds (at block 410), or one or more audio elements that are within the frequency similarity threshold(s) are not within the timestamp threshold (at block 414), or upon determining playback synchronization of the plurality of audio streams (at block 416), the method 400 may proceed to block 418, wherein the method 400 may include selecting one or more audio elements to be provided via one or more speakers 120 of the vehicle 102 and/or the speaker system 134 of the portable device 106.

In one or more embodiments, the element determinant module 146 may tag each of the plurality of audio elements of each of the plurality of audio streams with a respective descriptor that may pertain to types of sounds that may be associated with each of the plurality of audio elements. As discussed above, the descriptors may include, but may not be limited to, vocal, musical, sound graphic, sound effect, and the like that may pertain to the type of sound that is associated with each particular audio element.

In one embodiment, upon receiving the data pertaining to the plurality of audio elements, the source determinant module 148 may analyze each of the plurality of audio elements to determine one or more audio elements that are to be provided via one or more of the speakers 120 of the vehicle 102. Additionally, the source determinant module 148 may determine one or more additional audio elements of the plurality of audio elements to be provided via the speaker system 134 of the portable device 106.

As discussed in more detail above (with respect to block 310 of the method 300), the source determinant module 148 may analyze various inputs (e.g., particular types of audio elements, seated position of each user, descriptor of each audio element, ambient noise, additional playback audio within the vehicle 102) to determine one or more audio elements that are to be provided by one or more particular speakers 120 of the vehicle 102 and/or the speaker system 134 of the portable device 106.

In an alternate embodiment, if one or more of the audio elements from two or more of the plurality of audio streams are within one or more frequency similarity thresholds (as determined at block 412), the source determinant module 148 may select one or more audio elements from two or more of the audio streams that may be played back within the time span of the timestamp threshold to be provided globally through one or more speakers 120 within the interior cabin of the vehicle 102. For example, with reference to FIG. 2, the source determinant module 148 may determine one or more audio elements that include mid-bass audio elements of the plurality of audio streams to be provided by one or more mid-bass speakers 120*e* of the vehicle 102.

In one configuration, the source determinant module 148 may change a playback speed and/or pitch of the plurality of audio streams to be played back via one or more of the speakers 120 of the vehicle 102 and/or the speaker system 134 of the plurality of portable devices 106 in order to provide a seamless global audio experience that synchronizes the playback of the plurality of audio streams (with the same audio content) with the playback of the additional audio being played back within the vehicle 102.

In another configuration, the source determinant module 148 may also control playback (e.g., control the start of playback) or change the playback speed of one or more portions of graphics/images/video to provide the seamless global visual and audio experience. For example, the module 148 may control the playback of various gaming elements of a gaming application that is executed through one or more of the plurality of portable devices 106 such that one or more of the users is provided with particular audio elements at particular times that match with one or more audio elements that are being played back within the vehicle 102.

The method 400 may proceed to block 420, wherein the method 400 may include communicating commands to playback the plurality of audio elements. In an exemplary embodiment, upon selecting the one or more audio elements to be provided via one or more of the speakers 120 of the vehicle 102 and the speaker system 134 of the portable device 106, the source determinant module 148 may communicate commands to playback one or more of the selected plurality of audio elements through one or more of the speakers 120 and one or more of the alternate/additional selected plurality of audio elements through the speaker system 134.

More specifically, the source determinant module 148 may communicate one or more respective commands to the audio system 118, the ECU 110, and/or the head unit 112 of the vehicle 102 to utilize one or more of the speakers 120 of the vehicle 102 to playback the one or more audio elements of each of the plurality of audio streams as selected by the source determinant module 148. Additionally, the source determinant module 148 may communicate one or more respective commands to the processor 128 and/or the speaker system 134 of the portable device 106 to playback one or more additional audio elements of each of the plurality of audio streams as selected by the source determinant module 148.

As an illustrative example, the source determinant module 148 may send one or more commands to the audio system 118 of the vehicle 102 to playback one or more audio elements that include bass audio elements of the plurality of audio streams via one or more of the speakers of the vehicle 102. Furthermore, the module 148 may send one or more commands to the speaker system 134 to playback one or more alternate/additional individual audio elements (e.g., that are not matching nor are within one or more frequency similarity thresholds) associated with one or more respective audio streams via the speaker system 134 to be provided via headphones to one or more of the plurality of users.

In some embodiments, the source determinant module 148 may also communicate one or more commands to the processor 128 of the portable device 106 to control the playback of the one or more audio elements in one or more speeds or pitches and/or one or more portions of graphics/images/video in one or more speeds. Additionally, the source determinant module 148 may communicate one or more commands to the lighting system 122 of the vehicle 102 to enable or disable one or more of the interior lights of the vehicle 102 to provide an immersive visual experience that may correspond to the shared three-dimensional audio experience provided by the application 104.

In some configurations, the source determinant module 148 may be further configured to mute (e.g., remove) one or more particular audio elements from one or more of the plurality of audio streams to ensure that the particular audio element(s) is not played back via the speakers 120 of the vehicle 102 and/or the speaker system 134 of the portable device 106. Consequently, such audio elements may be replaced with the matching audio elements included within additional playback audio being played by the audio system 118 of the vehicle 102 or one or more additional audio streams of the plurality of audio streams based on the applications executed on each of the plurality of portable devices 106. This functionality may be utilized to provide the plurality of users with a seamless audio experience that blends audio from each of the plurality of audio streams with one another and/or additional playback audio to thereby provide the shared three-dimensional audio experience within the interior cabin of the vehicle 102.

Figure 5:
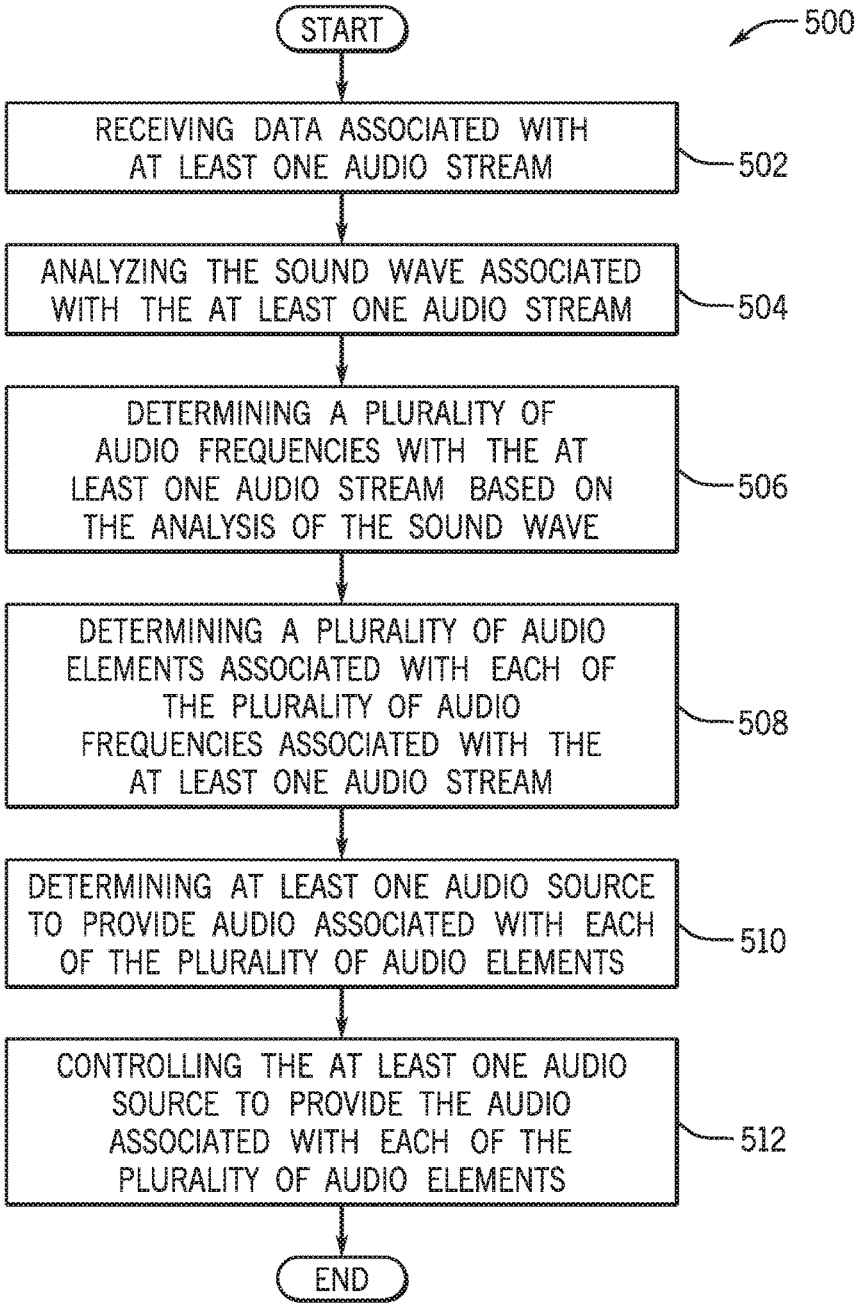
FIG. 5 is a process flow diagram of a method for providing a shared audio experience according to an exemplary embodiment.

FIG. 5 is a process flow diagram of a method 500 for providing a shared audio experience according to an exemplary embodiment. FIG. 5 will be described with reference to the components of FIG. 1 though it is to be appreciated that the method of FIG. 5 may be used with other systems and/or components. The method 500 may begin at block 502, wherein the method 500 may include receiving data associated with at least one audio stream. In one embodiment, as discussed above in more detail, a sound wave is generated from the at least one audio stream.

The method 500 may proceed to block 504, wherein the method 500 may include analyzing the sound wave associated with the at least one audio stream. The method 500 may proceed to block 506, wherein the method 500 may include determining a plurality of audio frequencies associated with the at least one audio stream based on the analysis of the sound wave.

The method 500 may proceed to block 508, wherein the method 500 may include determining a plurality of audio elements associated with each of the plurality of audio frequencies associated with the at least one audio stream. The method 500 may proceed to block 510, wherein the method 500 may include controlling the at least one audio source to provide the audio associated with each of the plurality of audio elements. In one embodiment, the at least one audio source is at least one speaker 120 of a vehicle 102 and at least one audio source is a speaker system 134 of a portable device 106.

It should be apparent from the foregoing description that various exemplary embodiments of the invention may be implemented in hardware. Furthermore, various exemplary embodiments may be implemented as instructions stored on a non-transitory machine-readable storage medium, such as a volatile or non-volatile memory, which may be read and executed by at least one processor to perform the operations described in detail herein. A machine-readable storage medium may include any mechanism for storing information in a form readable by a machine, such as a personal or laptop computer, a server, or other computing device. Thus, a non-transitory machine-readable storage medium excludes transitory signals but may include both volatile and non-volatile memories, including but not limited to read-only memory (ROM), random-access memory (RAM), magnetic disk storage media, optical storage media, flash-memory devices, and similar storage media.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in machine readable media and so executed by a computer or processor, whether or not such computer or processor is explicitly shown.

It will be appreciated that various implementations of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A computer-implemented method for providing a shared audio experience, comprising:

receiving data associated with at least one audio stream, wherein a sound wave is generated from the at least one audio stream;

analyzing the sound wave associated with the at least one audio stream;

determining a plurality of audio frequencies associated with the at least one audio stream based on the analysis of the sound wave;

determining a plurality of audio elements associated with each of the plurality of audio frequencies associated with the at least one audio stream;

determining at least one audio source to provide audio associated with each of the plurality of audio elements; and controlling the at least one audio source to provide the audio associated with each of the plurality of audio elements, wherein the at least one audio source is at least one of: at least one speaker of a vehicle and a speaker system of a portable device.

2. The computer-implemented method of claim 1, wherein the at least one audio stream includes at least one audio clip of at least one length and at least one size that corresponds to content displayed through a display unit of the portable device.

3. The computer-implemented method of claim 1, wherein analyzing the sound wave includes electronically analyzing at least one predetermined portion of the sound wave associated to at least one period of time of the sound wave to determine a number of oscillations per second of the at least one predetermined portion.

4. The computer-implemented method of claim 1, wherein determining a plurality of audio elements includes electronically analyzing frequency measurements of each of the plurality of frequencies against a plurality of frequency range threshold values.

5. The computer-implemented method of claim 1, wherein the plurality of audio elements include at least one of: a low-bass audio element, a mid-bass audio element, an upper-bass audio element, a lower midrange audio element, a middle midrange audio element, an upper midrange audio element, a lower treble audio element, a middle treble audio element, an upper treble audio element and an top octave audio element.

6. The computer-implemented method of claim 5, wherein controlling the at least one audio source to provide the audio includes controlling the at least one speaker of the vehicle to playback at least one of: the low-bass audio element, the mid-bass audio element, and the upper-bass audio element, wherein the speaker system of the portable device is controlled to playback at least one alternate audio element.

7. The computer-implemented method of claim 1, further including receiving data associated with a plurality of audio streams that include different audio content, wherein it is determined if at least one audio element from at least two audio streams of the plurality of audio streams is within at least one frequency similarity threshold.

8. The computer-implemented method of claim 7, wherein a timestamp associated with the at least one audio element of each of the at least two audio streams within the at least one frequency similarity threshold are compared to a timestamp threshold to determine if playback of the at least one audio element of each of the at least two audio streams occurs within a timespan of the timestamp threshold.

9. The computer-implemented method of claim 8, further including analyzing the at least one audio element of each of the at least two audio streams occurs within the timespan of the timestamp threshold and determining playback synchronization of the two audio streams, wherein the at least one audio element is played back through the at least one speaker of the vehicle.

10. A system for providing a shared audio experience, comprising:

a memory storing instructions when executed by a processor cause the processor to:

receive data associated with at least one audio stream, wherein a sound wave is generated from the at least one audio stream;

analyze the sound wave associated with the at least one audio stream;

determine a plurality of audio frequencies associated with the at least one audio stream based on the analysis of the sound wave;

determine a plurality of audio elements associated with each of the plurality of audio frequencies associated with the at least one audio stream;

determine at least one audio source to provide audio associated with each of the plurality of audio elements; and control the at least one audio source to provide the audio associated with each of the plurality of audio elements, wherein the at least one audio source is at least one of: at least one speaker of a vehicle and a speaker system of a portable device.

11. The system of claim 10, wherein the at least one audio stream includes at least one audio clip of at least one length and at least one size that corresponds to content displayed through a display unit of the portable device.

12. The system of claim 10, wherein analyzing the sound wave includes electronically analyzing at least one predetermined portion of the sound wave associated to at least one period of time of the sound wave to determine a number of oscillations per second of the at least one predetermined portion.

13. The system of claim 10, wherein determining a plurality of audio elements includes electronically analyzing frequency measurements of each of the plurality of frequencies against a plurality of frequency range threshold values.

14. The system of claim 10, wherein the plurality of audio elements include at least one of: a low-bass audio element, a mid-bass audio element, an upper-bass audio element, a lower midrange audio element, a middle midrange audio element, an upper midrange audio element, a lower treble audio element, a middle treble audio element, an upper treble audio element and an top octave audio element.

15. The system of claim 14, wherein controlling the at least one audio source to provide the audio includes controlling the at least one speaker of the vehicle to playback at least one of: the low-bass audio element, the mid-bass audio element, and the upper-bass audio element, wherein the speaker system of the portable device is controlled to playback at least one alternate audio element.

16. The system of claim 10, further including receiving data associated with a plurality of audio streams that include different audio content, wherein it is determined if at least one audio element from at least two audio streams of the plurality of audio streams is within at least one frequency similarity threshold.

17. The system of claim 16, wherein a timestamp associated with the at least one audio element of each of the at least two audio streams within the at least one frequency similarity threshold are compared to a timestamp threshold to determine if playback of the at least one audio element of each of the at least two audio streams occurs within a timespan of the timestamp threshold.

18. The system of claim 17, further including analyzing the at least one audio element of each of the at least two audio streams occurs within the timespan of the timestamp threshold and determining playback synchronization of the two audio streams, wherein the at least one audio element is played back through the at least one speaker of the vehicle.

19. A non-transitory computer readable storage medium storing instructions that when executed by a computer, which includes a processor perform a method, the method comprising:

receiving data associated with at least one audio stream, wherein a sound wave is generated from the at least one audio stream;

analyzing the sound wave associated with the at least one audio stream;

determining a plurality of audio frequencies associated with the at least one audio stream based on the analysis of the sound wave;

determining a plurality of audio elements associated with each of the plurality of audio frequencies associated with the at least one audio stream;

determining at least one audio source to provide audio associated with each of the plurality of audio elements; and controlling the at least one audio source to provide the audio associated with each of the plurality of audio elements, wherein the at least one audio source is at least one of: at least one speaker of a vehicle and a speaker system of a portable device.

20. The non-transitory computer readable storage medium of claim 19, wherein analyzing the sound wave includes electronically analyzing at least one predetermined portion of the sound wave associated to at least one period of time of the sound wave to determine a number of oscillations per second of the at least one predetermined portion.

* * * * *